US009903624B2

(12) United States Patent
Bertilsson et al.

(10) Patent No.: US 9,903,624 B2
(45) Date of Patent: Feb. 27, 2018

(54) SYSTEM AND METHOD FOR DYNAMIC CONTROL OF AN EVAPORATOR

(71) Applicant: ALFA LAVAL CORPORATE AB, Lund (SE)

(72) Inventors: Klas Bertilsson, Eslöv (SE); Anders Nyander, Staffanstorp (SE); Alvaro Zorzin, Romans d'Isonzo (IT)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/407,640

(22) PCT Filed: Jun. 11, 2013

(86) PCT No.: PCT/EP2013/061984
§ 371 (c)(1),
(2) Date: Dec. 12, 2014

(87) PCT Pub. No.: WO2013/186195
PCT Pub. Date: Dec. 19, 2013

(65) Prior Publication Data

US 2015/0135747 A1 May 21, 2015

(30) Foreign Application Priority Data

Jun. 14, 2012 (EP) ..... 12171918

(51) Int. Cl.
*F25B 39/02* (2006.01)
*F28F 9/22* (2006.01)
(Continued)

(52) U.S. Cl.
CPC ..... *F25B 49/02* (2013.01); *F25B 39/022* (2013.01); *F25B 39/028* (2013.01);
(Continued)

(58) Field of Classification Search
CPC ..... F25B 2341/0661; F25B 2341/0015; F25B 39/02; F25B 39/022; F25B 39/024;
(Continued)

(56) References Cited

U.S. PATENT DOCUMENTS 3,977,205 A 8/1976 Dreisziger et al.
4,499,739 A 2/1985 Matsuoka et al.
(Continued)

FOREIGN PATENT DOCUMENTS

CN 101329115 A 12/2008
CN 102187165 A 9/2011
(Continued)

OTHER PUBLICATIONS

International Search Report (PCT/ISA/210) dated Jul. 17, 2013, by the European Patent Office as the International Searching Authority for International Application No. PCT/EP2013/061984.
(Continued)

*Primary Examiner* — Frantz Jules
*Assistant Examiner* — Erik Mendoza-Wilkenfel
(74) *Attorney, Agent, or Firm* — Buchanan Ingersoll & Rooney PC

(57) ABSTRACT

The invention relates to a plate heat exchanger including a plate package, which includes a number of first and second heat exchanger plates which are joined to each other and arranged side by side in such a way that first and second plate interspaces are formed. At least two injectors are provided, each injector being arranged to supply a first fluid to at least one of the first plate interspaces in the at least one plate package and at least one valve is arranged to control the supply of the first fluid to the at least two injectors.

19 Claims, 7 Drawing Sheets

(51) Int. Cl.

| | |
|---|---|
| ***F28D 9/00*** | (2006.01) |
| ***F25B 49/02*** | (2006.01) |
| ***F28F 9/02*** | (2006.01) |
| ***F28F 27/02*** | (2006.01) |
| ***F28D 1/03*** | (2006.01) |

(52) U.S. Cl.
CPC ..... *F28D 1/0333* (2013.01); *F28D 9/005* (2013.01); *F28F 9/027* (2013.01); *F28F 27/02* (2013.01); *F25B 2341/0661* (2013.01); *F25B 2600/21* (2013.01); *F25B 2600/2513* (2013.01); *F25B 2700/197* (2013.01); *F25B 2700/21175* (2013.01)

(58) Field of Classification Search
CPC .... F25B 2313/0233; F25B 2313/02331; F25B 2339/022; F25B 2339/0241; F28F 9/22; F28D 9/0006; F28D 9/0031; F28D 9/0043; F28D 9/005
See application file for complete search history.

(56) References Cited

U.S. PATENT DOCUMENTS

| | | | | |
|---|---|---|---|---|
| 5,402,652 | A | 4/1995 | Alsenz | |
| 6,415,619 | B1 * | 7/2002 | Bash | F25B 5/02 257/E23.098 |
| 7,147,037 | B2 | 12/2006 | Jenkins | |
| 7,152,663 | B2 | 12/2006 | Helin et al. | |
| 8,156,750 | B2 | 4/2012 | Butorac et al. | |
| 2004/0134637 | A1 * | 7/2004 | Helin | F28D 9/005 165/11.1 |
| 2006/0162358 | A1 * | 7/2006 | VanderZee | F25B 49/02 62/225 |
| 2007/0289318 | A1 | 12/2007 | Nakamura | |
| 2008/0257538 | A1 | 10/2008 | Persson | |
| 2009/0133435 | A1 * | 5/2009 | Toyoshima | F25B 31/004 62/473 |
| 2009/0277196 | A1 * | 11/2009 | Gambiana | F25B 39/028 62/115 |
| 2010/0012310 | A1 * | 1/2010 | Christensen | F28F 27/02 165/260 |
| 2010/0242505 | A1 | 9/2010 | Thybo et al. | |
| 2010/0252232 | A1 * | 10/2010 | Reich | F28D 20/0034 165/48.1 |
| 2011/0011125 | A1 * | 1/2011 | Kasahara | F25B 13/00 62/498 |
| 2011/0113803 | A1 | 5/2011 | Ahn et al. | |
| 2014/0020883 | A1 | 1/2014 | Christensen et al. | |

FOREIGN PATENT DOCUMENTS

| | | | |
|---|---|---|---|
| DK | 171519 | B1 | 12/1996 |
| EP | 0 608 195 | B1 | 7/1994 |
| EP | 0 750 166 | A2 | 12/1996 |
| EP | 1 242 782 | B1 | 9/2002 |
| EP | 1 902 268 | A1 | 3/2008 |
| EP | 2156112 | B1 | 2/2010 |
| EP | 2 156 112 | B1 | 4/2011 |
| FR | 2849912 | A1 | 7/2004 |
| GB | 617461 | A | 2/1949 |
| GB | 2 229 295 | A | 9/1990 |
| JP | 50-15847 | A | 2/1975 |
| JP | 2005-315550 | A | 11/2005 |
| JP | 2007-040567 | A | 2/2007 |
| JP | 2008-151394 | A | 7/2008 |
| JP | 2008-175444 | A | 7/2008 |
| JP | 2010-249452 | A | 11/2010 |
| JP | 2010-261662 | A | 11/2010 |
| JP | 2011-127805 | A | 6/2011 |
| KR | 10-2009-0102804 | A | 9/2009 |
| WO | 2005/103572 | A1 | 11/2005 |
| WO | 2008/076039 | A1 | 6/2008 |
| WO | 2008/151630 | A1 | 12/2008 |
| WO | WO 2008/151639 | A1 | 12/2008 |
| WO | 2010/017815 | A1 | 2/2010 |

OTHER PUBLICATIONS

Written Opinion (PCT/ISA/237) dated Oct. 9, 2013, by the European Patent Office as the International Searching Authority for International Application No. PCT/EP2013/061984.

English version of the First Office Action and Search Report dated Sep. 7, 2015, by the State Intellectual Property Office of People's Republic of China in corresponding Chinese Patent Application No. 201380030843.X (11 pgs).

English version of the Office Action (Notice of Preliminary Rejection) dated Nov. 12, 2015, by the Korean Intellectual Property Office in corresponding Korean Patent Application No. 10-2015-7000566 ( 4 pgs).

An English Translation of the Office Action (Notice of Reasons for Rejection) dated Feb. 1, 2016, by the Japanese Patent Office in corresponding Japanese Patent Application No. 2015-516585. (5 pages).

Japanese Official Action dated Sep. 5, 2016, by the Japan Patent Office, in corresponding Japanese Patent Application No. 2015-516585 (5 pages).

Office Action dated May 2, 2016, by the European Patent Office in corresponding Europan Patent Application No. 12 171 918.1-1602. (5 pages).

Decision to Grant a Patent issued Mar. 27, 2017, by the Japanese Patent Office in corresponding Japanese Patent Application No. 2015-516585 (3 pages), and English language translation of Decision to Grant a Patent.

* cited by examiner

SYSTEM AND METHOD FOR DYNAMIC CONTROL OF AN EVAPORATOR

TECHNICAL FIELD

The present invention refers generally to a system for dynamic control of the operation of an evaporator. Further, the invention refers to a method for dynamic control of the operation of an evaporator.

BACKGROUND ART

The present invention refers generally to a system comprising an evaporator and in particular to an evaporator in the form of a plate heat exchanger. Generally, an evaporator is designed for evaporation of a fluid, such as a cooling agent, for various applications, such as air conditioning, cooling systems, heat pump systems, etc. Thus the evaporator may be used in a two-phase system handling a fluid in a liquid form as well as in a gaseous or evaporated form.

In case of the evaporator being a plate heat exchanger, this may by way of example include a plate package, which includes a number of first and second heat exchanger plates. The plates are permanently joined to each other and arranged side by side in such a way that a first plate interspace, forming a first fluid passage, is formed between each pair of adjacent first heat exchanger plates and second heat exchanger plates, and a second plate interspace, forming a second fluid passage, between each pair of adjacent second heat exchanger plates and first heat exchanger plates. The first plate interspaces and the second plate interspaces are separated from each other and provided side by side in an alternating order in the plate package. Substantially each heat exchanger plate has at least a first porthole and a second porthole, wherein the first portholes form a first inlet channel to the first plate interspaces and the second portholes form a first outlet channel from the first plate interspaces and wherein the plate package includes a separate space for each of said first plate interspaces, which space is closed to the second plate interspaces.

In this general prior art plate heat exchanger to be used in a two-phase system a first fluid, such as a cooling agent, is introduced into the valve in liquid form but expands when going through the valve due to the pressure drop into a partly evaporated fluid at one end of the first inlet channel, i.e. the first port hole, for further distribution along the first inlet channel and further into each of the individual first plate interspaces during evaporation into an evaporated form. There is always a risk that the energy content of the supplied fluid is too high, whereby a part of the flow supplied to the inlet channel via its inlet port will meet the rear end of the inlet channel and be reflected thereby in the opposite direction. Thereby the flow in the inlet channel is very chaotic and hard to predict and control.

Further, the pressure drop of the cooling agent may increase with the distance from the inlet to the first inlet channel, whereby the distribution of the first fluid between the individual plate interspaces will be affected. It is known that the angular flow change that the droplets of the first fluid must undergo when entering the individual plate interspaces from the first inlet channel contributes to an uneven distribution. Yet another influencing parameter is dimensional differences between the individual first plate interspaces, resulting in that each first plate interspace has its unique efficiency. It is also to be known that the operation and performance of an individual first plate interspace depends on its position in a plate package. The outer most first plate interspaces on each side of the plate package tend to behave different than those in the middle of the plate package.

As a result of this it is very hard, or even impossible, to optimize the operation and efficiency of an evaporator as a whole, ensuring that all fluid supplied to the evaporator is fully evaporated before leaving the outlet of the evaporator and especially before reaching the inlet of a compressor to be arranged downstream of the outlet of the evaporator. In fact it is sufficient that there is one malfunctioning first plate interspace for insufficient evaporation of the evaporator as a whole to occur. By way of example, if one single first plate interspace is flooded, i.e. is incapable of evaporating the complete amount of fluid supplied thereto, droplets will occur downstream the outlet of the evaporator. Generally, by fully evaporated means that the evaporated fluid must have reached a superheating temperature difference whereby the evaporated fluid comprises dry evaporated fluid only, i.e. the evaporated fluid should have a temperature being higher than the saturation temperature at a prevailing pressure.

The purpose of operating the evaporator as close to a superheating set-point temperature as possible no matter operation duty is of importance to get as high utilization factor as possible. Thus, it is of economic importance. Further, it has an influence to other components cooperating with the evaporator, such as a compressor, since compressors normally are sensitive to liquid content. Any droplets remaining in the evaporated fluid when reaching the inlet of the compressor may damage the same. Also, there is an economical interest of operating the evaporator as close to the superheating temperature difference as possible since once the fluid has reached the superheating temperature difference the fluid is completely dry and there is no substantial gain in increasing the temperature additionally. The superheating temperature set-point above is determined by the system manufacturer to incorporate a certain wanted safety margin against the risk of receiving liquid into the compressor. The problems discussed above get more pronounced when the load of the evaporator is changed. This may by way of example be the case when changing the operation duty of an air conditioning system, from one temperature to another, meaning that the amount of fluid to be supplied to the evaporator is changed.

Documents EP2156112B1 and WO2008151639A1 provide a method for controlling a refrigerant distribution among at least two evaporators in such a manner that the refrigeration capacity of air-heated evaporators is utilized to the greatest possible extent. This is made by monitoring a superheat of refrigerant at a common outlet of the evaporators. Further, this is made by altering a mass flow of refrigerant through a selected evaporator while keeping the total mass flow of refrigerant through all the evaporators substantially constant. The flow is controlled by one single valve being an expansion valve. Thus, the two documents provide a solution to controlling the operation of a plurality of air-heated evaporators, in which method each evaporator is evaluated as a complete unit and in which method each unit is controlled in view of additional evaporators arranged in the same circuit.

Other examples of documents disclosing systems comprising multiple evaporators and/or multiple heat exchangers are U.S. Pat. No. 6,415,519B1 and EP0750166A2. In U.S. Pat. No. 6,415,519B1, multiple evaporators are utilized for cooling a multi-component computer system. In EP0750166A2, a plurality of indoor heat-exchangers is disclosed. Also these two documents provide solutions to controlling the operation of a plurality of heat-exchangers and/or evaporators in a system, in which each evaporator/heat-exchanger is evaluated as a complete unit.

Generally, the efficiency of evaporators and especially plate heat exchangers at part load is a raising issue. More focus is put on how the evaporator performs at different operation duties instead of being measured at only one operation duty. By way of example, laboratory scale trials have shown that an air-conditioning system can save 4-10% of its energy consumption just by improved evaporator function at part load for a given brazed plate heat exchanger. Further, an evaporator system is typically only operating at full capacity for 3% of the time, while most evaporators are designed and tuned for a full capacity operation.

SUMMARY

The object of the present invention is to provide an improved evaporator system remedying the problems mentioned above. Especially it is aimed at an evaporator and a method which allows a better control and distribution of the supply of the first fluid, such as the cooling agent, between the fluid passages to thereby improve its efficiency of the plate heat exchanger no matter running condition.

This object is achieved by a system for dynamic control of the operation of an evaporator, the system comprising an evaporator, a plurality of injector arrangements, a sensor arrangement and a controller, wherein the evaporator comprises an outlet, a plurality of fluid passages and at least one inlet for the supply of a fluid to the outlet via the plurality of fluid passages during evaporation of the fluid, each injector arrangement comprises at least one injector and at least one valve, and each injector arrangement being arranged to supply a flow of the fluid to at least one of the fluid passages via the at least one inlet of the evaporator, the sensor arrangement is arranged to measure temperature and pressure of the evaporated fluid, or the presence of any liquid content in the evaporated fluid, and the controller is arranged to communicate with the valves of the injector arrangements for the valves to control, based on information received from the sensor arrangement, the amount of fluid to be supplied by each injector arrangement to each fluid passage in the evaporator in order for the evaporator to operate towards a set-point superheating value.

By a system having this configuration, the operation of each fluid passage or a smaller amount of fluid passages may to be monitored, whereby the contribution from each individual fluid passage to the overall performance of the evaporator may be adjusted in order for the evaporator to operate towards a set-point superheating value.

By the term "liquid content" is in the following defined as fluid being in a liquid phase or a mixed liquid/evaporated phase. It may by way of example be in the form of droplets.

Provided the sensor arrangement is arranged to measure temperature and pressure, the set-point superheating value may by way of example be decided by the manufacturer of the system to safeguard against the risk of having liquid entering the compressor. In case the sensor arrangement is arranged to instead measure the presence of any liquid content in the evaporated fluid, the set-point superheating value may be handled in a "digital" manner, wherein presence of any liquid content is an indicator of the amount of fluid supplied to the evaluated fluid passage is too high for a complete evaporation, or alternatively, no presence of any liquid content is an indicator of the amount of fluid supplied to the fluid passage being insufficient and may be increased.

By operating the inventive system continuously, to each fluid passage one after the other, the operation of the evaporator may be iteratively optimized in view of a desired operation duty. This allows the size/dimensions of the evaporator to be optimized. Also, not at least, the energy consumption required to operate a system comprising the evaporator as one component may be reduced. It also allows the possibility to use a smaller compressor to be arranged downstream of the evaporator.

Each injector in an injector arrangement may be arranged to communicate with one valve, or alternatively, a plurality of injectors in an injector arrangement may be arranged to communicate with one valve. Accordingly, one and the same valve may control the amount of fluid supplied to each fluid passage based on the instructions received from the controller.

Each injector arrangement may be arranged to communicate with one fluid passage, or alternatively, each injector arrangement may be arranged to communicate with at least two fluid passages. This allows the operation of each fluid passage or a smaller number of fluid passages to be controlled, whereby the contribution from each individual fluid passage to the overall performance of the evaporator may be adjusted and optimized.

The sensor arrangement may be arranged in a tube system connecting the outlet of the evaporator with an inlet of a compressor. Thereby the inherent temperature of the tube system may be used to further contribute to the evaporation of any remaining liquid content in the fluid after the outlet of the evaporator.

The controller may be a P regulator, a PI regulator or a PID regulator. These regulator types are well known in the field of automatic control engineering. The PID regulator may be used to relatively fast find the set-point without causing any self-oscillation of the system. Other types of regulators may also be suitable.

The evaporator may be a plate heat exchanger. The plate heat exchanger may by way of example be a plate heat exchanger having first and second fluid passages and four port holes allowing a flow of two fluids. It is to be understood that the invention is equally applicable to plate heat exchangers having different configurations in terms of the number of fluid passages, the number of port holes and the number of fluids to be handled.

The sensor arrangement may comprise at least one temperature sensor and at least one pressure sensor. The two sensors must not have the same position.

Alternatively, in case the sensor arrangement is arranged to measure the presence of any liquid content in the evaporated fluid, the sensor arrangement may be at least one temperature sensor. The temperature sensor may be used for determining a tendency of decreasing temperature as seen over a measuring period or be used for determining an unstable temperature as seen over a measuring period. Both a tendency of decreasing temperature and an unstable temperature may be used as input to the controller to establish the presence of any liquid content in the evaporated fluid since the liquid content, i.e. a fluid flow being in liquid phase or in a mixed liquid/evaporated phase will indicate a lower temperature on the temperature sensor than a fully evaporated, dry evaporated fluid flow.

According to another aspect, the invention relates to a method for dynamic control of the operation of an evaporator, the evaporator comprising at least one inlet, a plurality of fluid passages and an outlet, and the evaporator being included in a system further comprising a sensor arrangement, a controller and a plurality of injector arrangements, each injector arrangement comprising at least one injector and at least one valve, whereby the method comprises the steps of:

a) supplying via an inlet of the evaporator a pre-determined amount of fluid by a first injector arrangement to a first fluid passage for evaporation of the fluid during its passage to the outlet of the evaporator, b) measuring by the sensor arrangement temperature and pressure of the evaporated fluid or the presence of any liquid content in the evaporated fluid, c) determining, by the controller, the difference between a set-point super heating value and the measured values of the temperature and the pressure of the evaporated fluid, or the presence of any liquid content in the evaporated fluid, resulting from the pre-determined amount of supplied fluid, d) determining, by the controller, an adjusted amount of fluid to be supplied by the valve of the first injector arrangement to the first fluid passage required to reach the set-point superheating value, and e) continuously repeating steps a)-d) to each consecutive injector arrangement and each fluid passage of the evaporator for the purpose of providing a continuous control of the operation of the evaporator in order for the evaporator to operate towards a set-point superheating value.

By the method, the operation of each fluid passage or a smaller number of fluid passages may be monitored, whereby the contribution from each individual fluid passage to the overall performance of the evaporator may be continuously adjusted in order for the evaporator to operate towards a set-point superheating value with an optimized flow through each fluid passage. The optimization may be a maximizing of the amount of supplied fluid.

Provided the sensor arrangement is arranged to measure temperature and pressure, the set-point superheating value may by way of example be the superheating temperature for the specific fluid used in the system.

Alternatively, the superheating value may be the calculated superheating temperature for the specific fluid used in the system as adjusted with a pre-determined safety margin. In case the sensor arrangement is arranged to instead measure the presence of any liquid content in the evaporator, the set-point superheating value may be handled in a "digital" manner, wherein presence of any liquid content is an indicator of the amount of fluid supplied to the evaluated fluid passage being too high for a complete evaporation, or alternatively, no presence of any liquid content is an indicator of the amount of fluid supplied to the fluid passage being insufficient and may be increased.

Further, by the method, continuously monitoring and adjusting the operation of the individual fluid passages or groups of fluid passages, the operation of the evaporator may be iteratively optimized in view of a desired operation duty. More precisely, by repeating the method steps to each consecutive injector arrangement and to each fluid passage any unbalance in the evaporator as a whole between the pluralities of fluid passages may be taken care of. This allows the size/dimensions of the evaporator to be reduced which in turn allows a cost reduction. Not at least, the energy consumption required to operate a system comprising the evaporator as one component may be reduced.

The system may be operated during a period of time in a predetermined operation duty before initiating step a). In case of the evaporator 54 forming part of an air-conditioning system, this may by way of example be an operation duty corresponding to an office during normal working hour, such as 20° C. Thereby all components of the system will have a chance to be conditioned before initiating the optimization process.

In case the sensor arrangement is arranged to measure temperature and pressure of the evaporated fluid, the method may further comprise the steps of:

converting, by the controller, the measured pressure Pm into a saturation temperature Ts, determining the actual superheating temperature difference TshA, prevailing at the specific point of time when the temperature and pressure was measured, by comparing the measured temperature Tm with the saturation temperature Ts;

determining the temperature difference ΔT between a set-point superheating value being a set-point superheating temperature TshT and the actual superheating temperature difference TshA; and determining, based on the temperature difference, the need for any adjustment of the amount of fluid supplied by the valve of the first injector arrangement to the first fluid passage, and instructing the valve of the first injector arrangement to adjust the amount of fluid to be supplied by the first injector arrangement to the first fluid passage accordingly.

The conversion of the measured pressure into a saturation temperature may be made by the controller using pre-programmed information specific for the fluid used in the evaporator. Such information is readily available in graphs or tables plotting vapor pressure versus temperature for a specific fluid.

In case the sensor arrangement is a humidity sensor, the method may further comprise the steps of, provided the sensor generates a signal received by the controller indicating presence of any liquid content in the evaporated fluid, instructing the valve of the first injector arrangement to reduce the amount of fluid supplied to the first fluid passage, or provided the sensor generates a signal received by the controller indicating no presence of any liquid content in the evaporated fluid, instructing the valve of the first injector arrangement to increase the amount of fluid supplied to the first fluid passage.

This may be made by the humidity sensor being a temperature sensor determining a tendency of decreasing temperature as seen over a measuring period or determining an unstable temperature as seen over a measuring period. Both a tendency of decreasing temperature and an unstable temperature may be used as input to the controller to establish the presence of any liquid content in the evaporated fluid since a liquid phase or a mixed liquid/evaporated phase fluid will have a lower temperature than a fully evaporated, dry evaporated fluid flow.

In case the sensor arrangement comprises at least two humidity sensors, the method may further comprise the step of comparing the signals received by the controller from the at least two sensors indicating presence or no presence of any liquid content in the evaporated fluid in order to determine if to instruct the valve of the first injector arrangement to increase, decrease or maintain the supplied amount of fluid to the first fluid passage, and instructing the valve of the first injector arrangement to adjust the amount of fluid to be supplied by the first injector arrangement to the first fluid passage accordingly.

Again, this may be made by using humidity sensors in the form of temperature sensors, determining a tendency of decreasing temperature as seen over a measuring period or determining an unstable temperature as seen over a measuring period. By comparing the signals received by the controller from the at least two sensors it is possible, by the controller to determine any contribution from a tube system connecting the outlet of the evaporator with the inlet of a compressor to the evaporation. The tube system is typically hot, whereby any contact between any remaining liquid content in the evaporated fluid downstream of the outlet of the evaporator may cause an evaporation when such liquid content comes into contact with the tube system on its way to a compressor downstream thereof.

The method may further comprise, before continuing to step e), the step of communicating the determined adjusted amount of fluid to the valve of the first injector arrangement and adjusting the valve to supply an adjusted amount of fluid.

Thus, according to this embodiment, the operation of a first fluid passage is evaluated and its fluid supply is adjusted before continuing evaluating and adjusting the operation of the subsequent fluid passages.

Alternatively, the method may further comprise a step of communicating the determined adjusted amount of fluid to the valves of each injector arrangement and adjusting the valves to supply an adjusted amount of fluid to all fluid passages of the evaporator. Thus, according to this embodiment, the operation of each fluid passage is evaluated before all valves and their supply of fluid is adjusted.

When the operation of the evaporator has been operated to an operation duty meeting the set-point superheating value, the method may further comprise the step of adjusting the set-point superheating value before repeating the method steps for the purpose of anew providing a continuous control of the operation of the evaporator in order for the evaporator to operate towards the adjusted set-point superheating value. According to this embodiment, it is made possible to continuously refine the operation of the evaporator and its individual first fluid passages.

BRIEF DESCRIPTION OF THE DRAWINGS

Embodiments of the invention will now be described, by way of example, with reference to the accompanying schematic drawings, in which FIG. 1 schematically illustrates a prior art refrigeration circuit being a mechanical vapor compression system.

DETAILED DESCRIPTION

Figure 1:
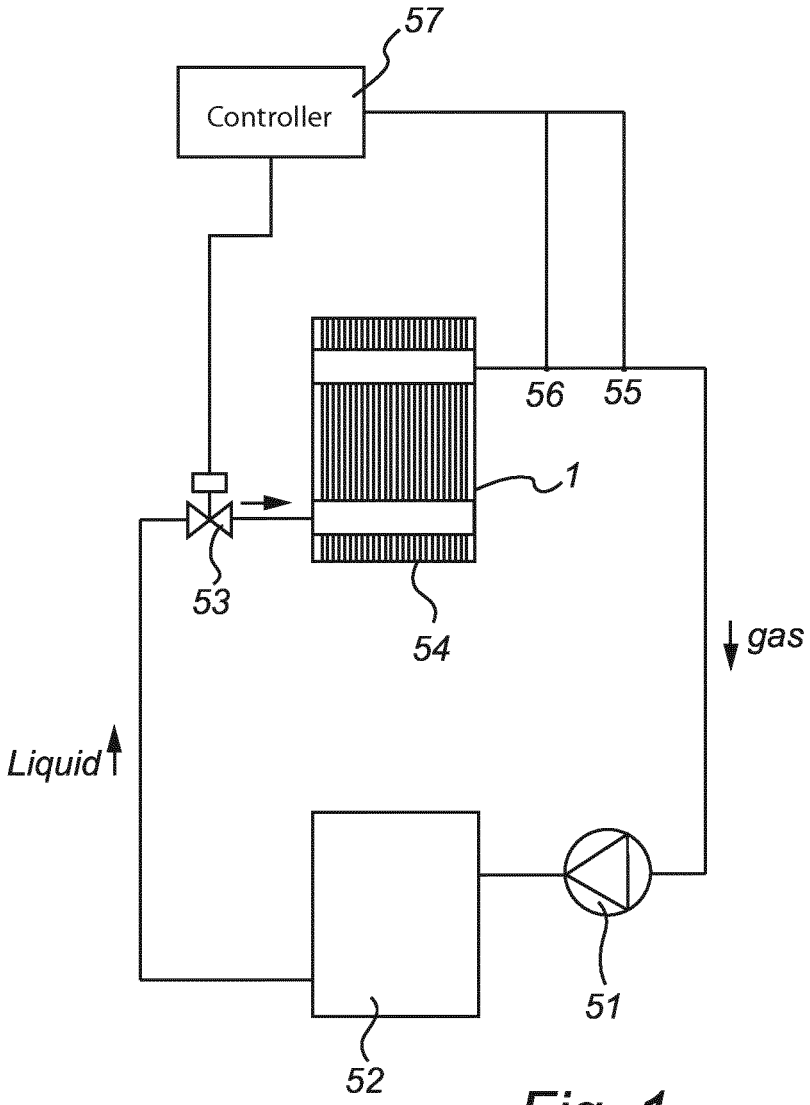

A heat exchanger 1 may typically be included as an evaporator in a refrigeration circuit. A prior art refrigeration system, see FIG. 1, being a mechanical vapor compression system, typically comprises a compressor 51, a condenser 52, an expansion valve 53 and an evaporator 54. The circuit may further comprise a pressure sensor 55 and a temperature sensor 56 arranged between the outlet of the evaporator and the inlet of the compressor. The refrigeration circle of such system starts when a cooling agent enters the compressor 51 in evaporated form with a low pressure and with a low temperature. The cooling agent is compressed by the compressor 51 to a high pressure and high temperature evaporated state before entering the condenser 52. The condenser 52 precipitates the high pressure and high temperature gas to a high temperature liquid by transferring heat to a lower temperature medium, such as water or air. The high temperature liquid then enters the expansion valve 53 where the expansion valve allows the cooling agent to enter the evaporator 54. The expansion valve 53 has the function of expanding the cooling agent from the high to the low pressure side, and to fine tuning the flow. In order for the higher temperature to cool, the flow into the evaporator must be limited to keep the pressure low and allow expansion back into the evaporated form. The expansion valve 53 may be operated by a controller 57 based on signals received from the pressure sensor 55 and the temperature sensor 56. The information may be used to indicate the overall operation of the evaporator 54 based on a so called super heating temperature being indicative of any liquid content remaining in the fluid after leaving the evaporator 54.

Figure 2:
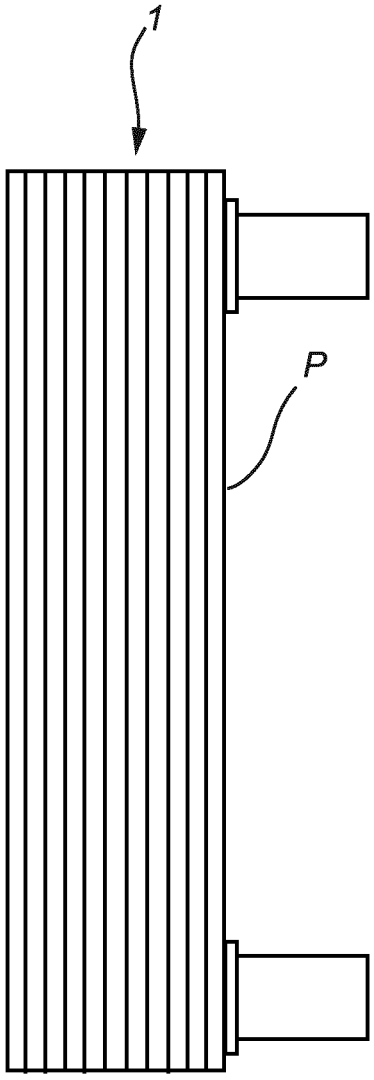
FIG. 2 discloses schematically a side view of a typical plate heat exchanger.
Figure 3:
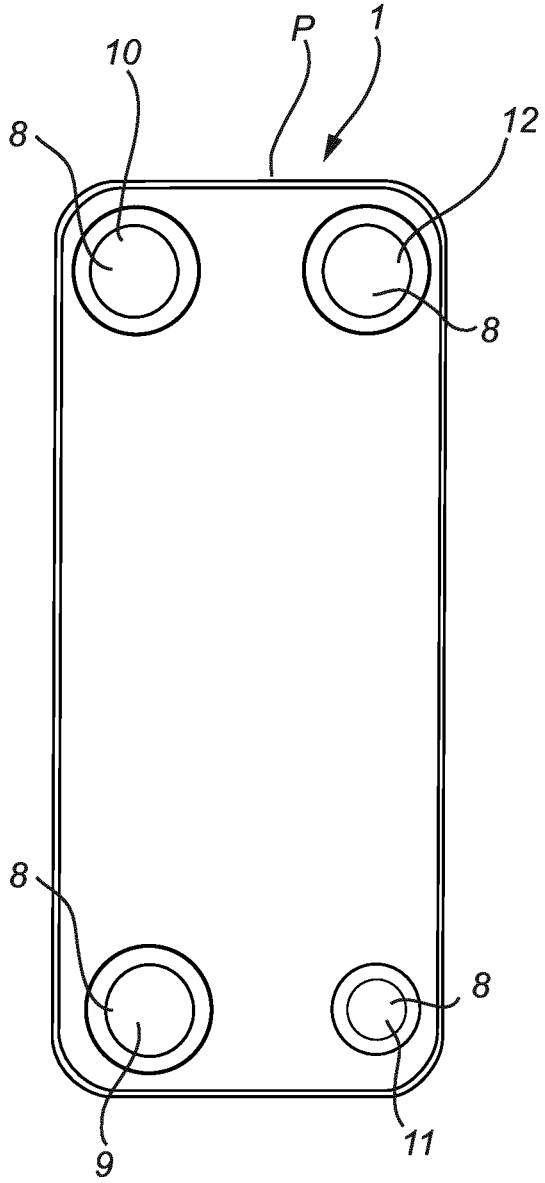
FIG. 3 discloses schematically a front view of the plate heat exchanger of FIG. 1.
Figure 4:
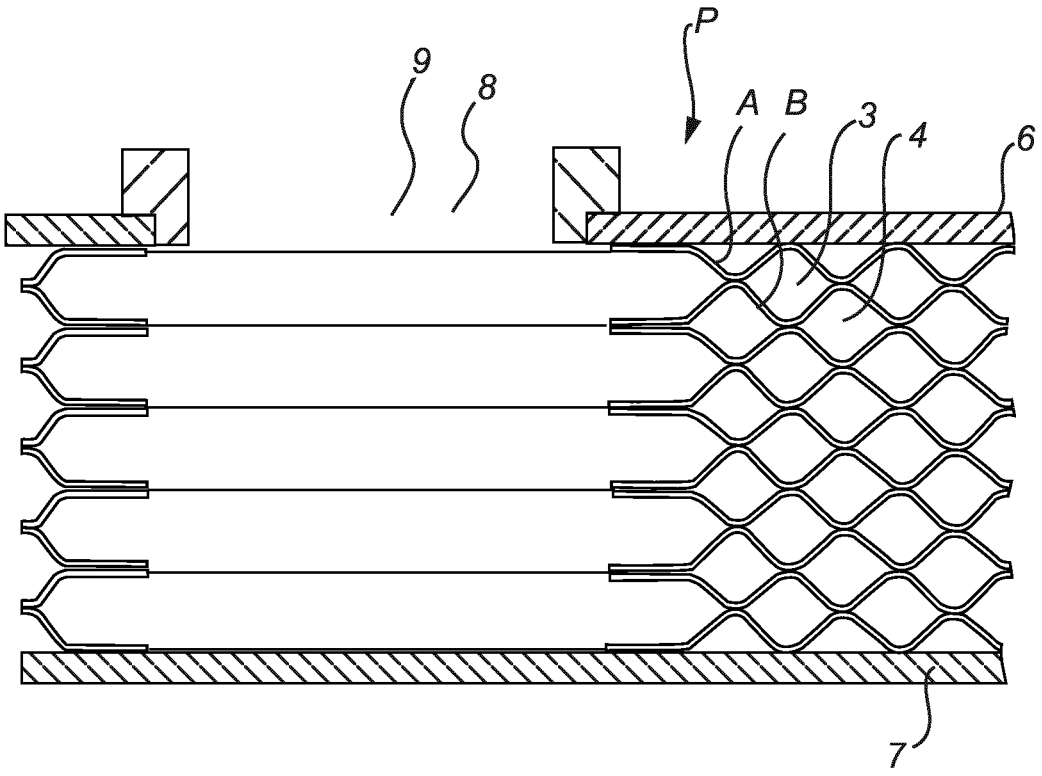
FIG. 4 discloses schematically a cross section along an edge of a prior art plate heat exchanger.

Now turning to FIGS. 2 to 4 a typical evaporator in the form of a plate heat exchanger 1 is disclosed. It is to be understood that the heat exchanger 1 may be of any type, such as a plate heat exchanger, a pipe and shell heat exchanger, a spiral heat exchanger etc. The invention will however in the following be discussed as applied to a plate heat exchanger 1, although the invention is not to be limited thereto.

The plate heat exchanger 1 includes a plate package P, which is formed by a number of heat exchanger plates A, B, which are provided side by side. The heat exchanger plates include in the embodiment disclosed two different plates, which in the following are called first and second heat exchanger plates A and B. The heat exchanger plates A, B are provided side by side in such a manner that a first fluid passage 3 is formed between each pair of adjacent first heat exchanger plates A and second heat exchanger plates B, and a second fluid passage 4 is formed between each pair of adjacent second heat exchanger plates B and first heat exchanger plates A. The plate package P further includes an upper end plate 6 and a lower end plate 7 provided on a respective side of the plate package P.

As appears from especially FIGS. 3 and 4, substantially each heat exchanger plate A, B has four portholes 8. The first portholes 8 form a first inlet channel 9 to the first fluid passages 3, which extends through substantially the whole plate package P, i.e. all plates A, B and the upper end plate 6. The second portholes 8 form a first outlet channel 10 from the first fluid passages 3, which also extends through substantially the whole plate package P, i.e. all plates A, B and the upper end plate 6. The third portholes 8 form a second inlet channel 11 to the second fluid passages 4, and the fourth portholes 8 form a second outlet channel 12 from the second fluid passages 4. Also these two channels 11 and 12 extend through substantially the whole plate package P, i.e. all plates A, B and the upper end plate 6.

Figure 5:
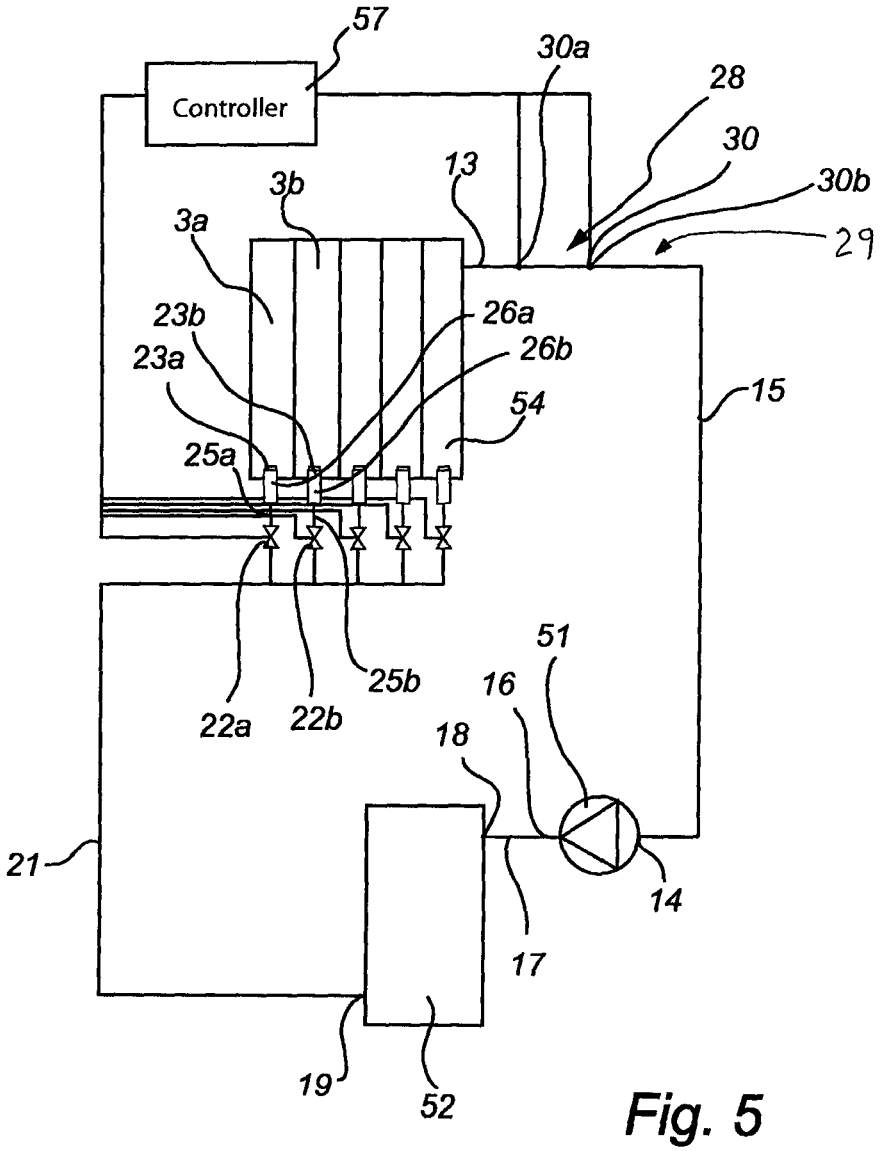
FIG. 5 discloses a refrigeration circuit relating to the inventive system.

Now turning to FIG. 5 a first embodiment of the inventive system will be discussed. The system comprises an evaporator 54 in the form of a plate heat exchanger. The outlet 13 of the evaporator 54 is connected to the inlet 14 of a compressor 51 via a tube system 15. Further, the outlet 16 of the compressor 51 is via another tube system 17 connected to the inlet 18 of a condenser 52. Yet further, the outlet 19 of the condenser 52 is connected to a plurality of injector arrangements 25*a*, 25*b*, each injector arrangement

25*a*, 25*b* comprising a valve 22*a*, 22*b* and an injector 23*a*, 23*b*, which injector arrangements 25*a*, 25*b* are connected to inlets of each first fluid passage 3*a*, 3*b* of the evaporator 54. Thus, a closed circulation system is provided.

Figure 6:
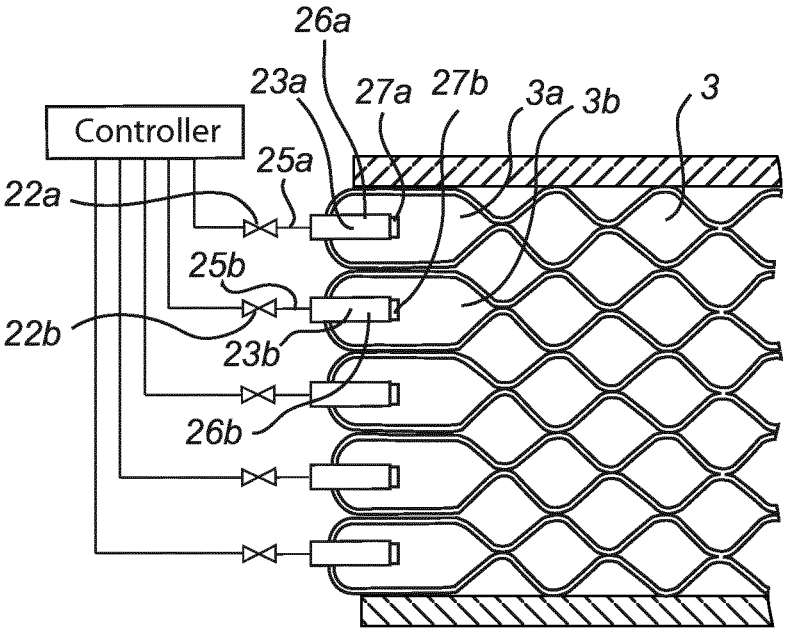
FIG. 6 discloses schematically a cross section along an edge of a plate heat exchanger applying the inventive system.

The plurality of injector arrangements 25*a*, 25*b*, see FIG. 6 are arranged to supply a flow of a first fluid via inlets 26*a*, 26*b* into the first fluid passages 3*a*, 3*b* for evaporation of the first fluid before leaving the evaporator 54 via its outlet 13. Each inlet arrangement 25*a*; 25*b* comprises one injector 23*a*; 23*b* and one valve 22*a*; 22*b*. The valves 22*a*; 22*b* are preferably positioned exterior of the evaporator 54, whereas the injectors 23*a*; 23*b* with nozzles 27*a*, 27*b*, if any, are positioned to extend inside the evaporator 54 via the inlets 26*a*; 26*b*.

The inlets 26*a*; 26*b* are in the form of through holes having an extension from the exterior of the plate package P to the interior of the plate package and more precisely into the individual first fluid passages 3*a*; 3*b*. The through holes may be formed by plastic reshaping, by cutting or by drilling. The term plastic reshaping refers to a non-cutting plastic reshaping such as thermal drilling. The cutting or drilling may be made by a cutting tool. It may also be made by laser or plasma cutting. A cross section of the inlet area of an evaporator possible to be used in the inventive system is disclosed in FIG. 6. The inlet channel 9 of the embodiment of FIG. 4 has been replaced by each first fluid passage 3 receiving an injector arrangement 25*a*; 25*b* via the inlets 26*a*, 26*b*.

It is to be understood that each inlet arrangement 25*a*; 25*b* may comprise a plurality of injectors 23*a*; 23*b*, wherein the plurality of injectors are communicating with one valve.

In its most simple form the nozzles 27*a*; 27*b* may be omitted whereby each injector 23*a*; 23*b* may be formed by a through hole (not disclosed) or a pipe (not disclosed) for distribution of the first fluid. Alternatively, the at least one injector 23*a*, 23*b* may be formed by the orifice of a valve. Thus, the orifice of the valve acts as a nozzle providing a spray pattern.

It is to be understood that the number of injectors 23*a*; 23*b* may be lower than the number of first fluid passages 3. Thereby each injector 23*a*; 23*b* may be arranged to supply its flow of the first fluid to more than one of the first fluid passages 3. This may be made possible by each injector being arranged in a through hole having a diameter extending across two or more fluid passages, whereby one and the same injector may supply fluid to more than one fluid passage.

The inventive system further comprises a sensor arrangement 28. In the disclosed embodiment the sensor arrangement 28 comprises one pressure sensor 29 and one temperature sensor 30. The sensor arrangement 28 may be arranged in the tube system 15 connecting the outlet 13 of the evaporator 54 with the inlet 14 of the compressor 51 and more precisely in or after the outlet 13 of the evaporator but before the inlet 14 of the compressor 51. The two sensors 29, 30 must not have the same position within the system. It may also be possible to arrange the sensor arrangement or a part thereof in the outlet channel (not disclosed) of the evaporator 54.

The pressure sensor 29 is preferably arranged after the outlet 13 of the evaporator 54 in a more or less straight section of the tube system 15 connecting the evaporator 54 with the compressor 51. Depending on the configuration of the tube system 15 it may, as a rule of thumb, be preferred, that the pressure sensor 29 is arranged on a distance after a tube bend corresponding to at least ten times the inner diameter of the tube, and on a distance before a tube bend corresponding to more than five times the inner diameter of the tube.

The pressure sensor 29 is arranged to measure the pressure of the evaporated first fluid, in the following identified as the measured pressure Pm.

The pressure sensor 29 may by way of example be a 4-20 mA pressure sensor with a range from 0-25 bar.

The temperature sensor 30 is preferably arranged in the tube system 15 after a tube bend. It is preferred that the temperature sensor 30 is arranged closer to the inlet 14 of the compressor 51 than to the outlet 13 of the evaporator 54. By positioning the temperature sensor 30 after a tube bend it is more likely that any remaining liquid content in the evaporated fluid is evaporated while meeting the walls of the tube bend and thereby being forced to change its flow direction. There is also an evaporation taking place by the remaining liquid contents absorbing heat from the surrounding superheated fluid flow.

The temperature sensor 30 may be a standard temperature sensor measuring the temperature, in the flowing identified as the measured temperature Tm.

The system further comprises a controller 57 arranged to communicate with the sensor arrangement 28 and the individual valves 22*a*; 22*b* of the injector arrangements 25*a*; 25*b*. The controller 57 may by way of example be a PID regulator.

The measured values regarding pressure Pm and temperature Tm are communicated to the controller 57 which is arranged to regulate the system based on a so called superheating temperature.

The superheating temperature, being a physical parameter well known in the art, is defined as the temperature difference between the present temperature and the saturated temperature at a prevailing pressure, i.e. there is not any liquid content remaining in the fluid. The superheating temperature difference is unique for a given fluid and for a given temperature and pressure and the super heating temperature may be found in graphs or tables.

Generally, the closer the measured temperature Tm comes to the saturation temperature, the more efficient the system becomes. That is, the amount of fluid supplied to the evaporator is completely evaporated and not unnecessary superheated.

However, the closer the measured temperature Tm comes to the saturation temperature, the closer it comes to flooding the system with non-evaporated fluid, i.e. the evaporator is incapable of evaporating the supplied amount of fluid. Solely for illustrative purpose, the superheating temperature may be regarded as being digital—either there is a complete evaporation without any liquid content, or there is an incomplete evaporation with liquid content contained in the evaporated flow downstream the evaporator.

In order to optimize the operation of an evaporator it is desired to have as low superheating temperature difference as possible. However, since a compressor is sensitive to liquid content and may be damaged thereby, its common praxis to use a safety margin of some degrees when designing an evaporation system. Typically, a normal safety margin for a prior art evaporator is 5° K, i.e. the superheating temperature difference is 5° K. However, it is to be understood that another value of the safety margin may be elected. In its most simple form, the safety margin is to be regarded as a constant decided by the intended use of the evaporator. It is however to be understood that there is also a desire to use as low safety margin as possible since there is an economical interest of operating the evaporator as close to the saturation temperature as possible. During the operation of the inventive system this constant will be used as a set-point superheating temperature TshT, i.e. a target value, towards which the operation of the evaporator 554 will be dynamically controlled. This will be made by optimizing the contribution from each first fluid passage 3*a*, 3*b* to the overall performance of the evaporator 54. More precisely, the underlying inventive concept is to control, by using one valve 22*a*, 22*b* and one injector 23*a*, 23*b* per fluid passage 3*a*, 3*b*, the amount of fluid supplied to each fluid passage 3*a*, 3*b*, in order to thereby optimize the evaporation of each fluid passage and also to maximize the fluid amount supplied thereto. This may be made by operating and evaluation each fluid passage 3*a*, 3*b* individually in a manner to be described below.

Figure 7:
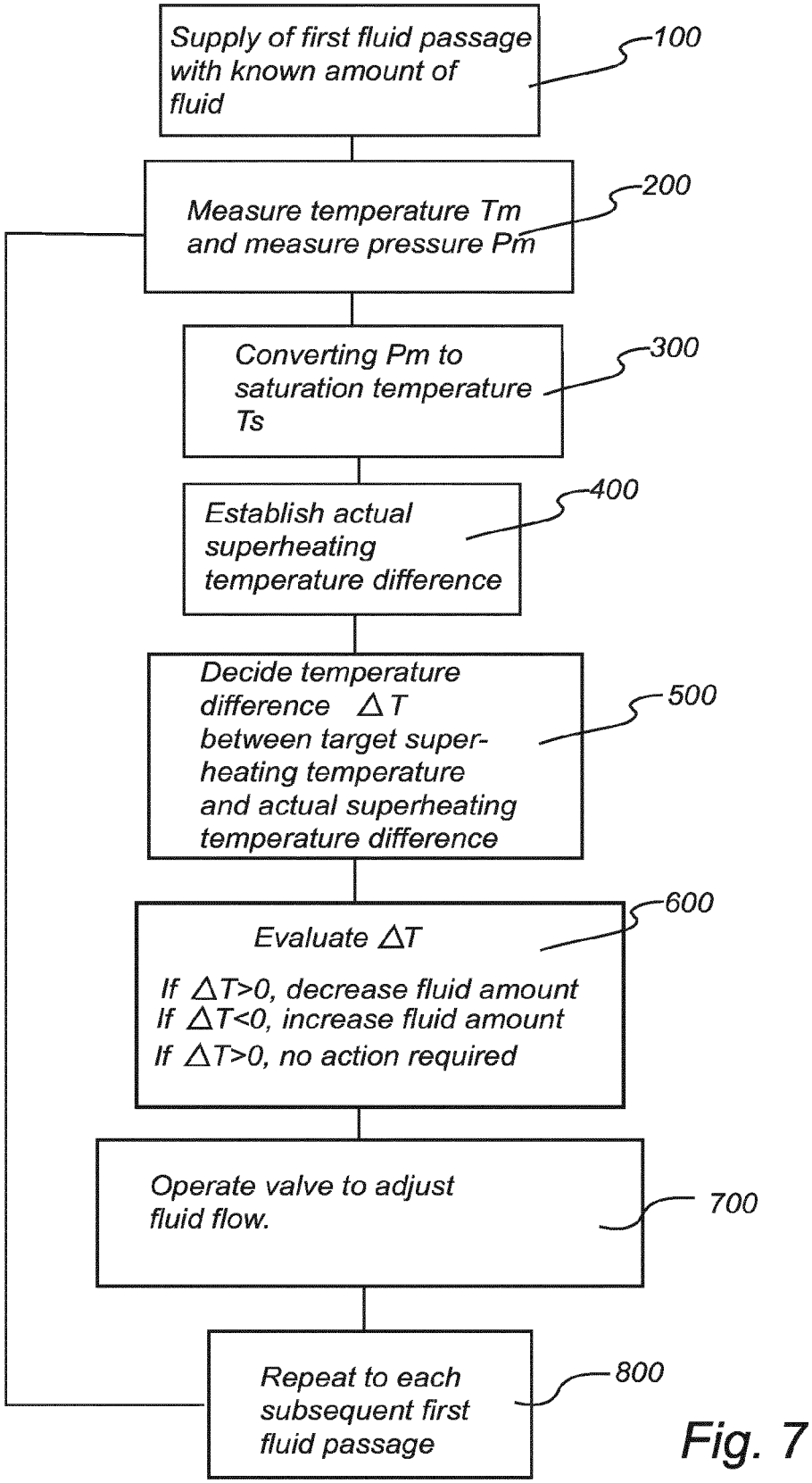
FIG. 7 discloses the steps of the inventive method using sensors for detecting temperature and pressure.

In the following the general principle for establishing the operation condition, i.e. superheating or not, will be described with reference to FIG. 7. To facilitate the understanding, the following example will be based on a system comprising an evaporator 54 with one first fluid passage 3*a* only which is supplied with the first fluid via an injector arrangement 25*a* comprising one injector 23*a* and one valve 22*a*. Further, the example is based on the assumption that the system has been operated during a period of time in a predetermined operation duty. In case of the evaporator 54 forming part of an air-conditioning system, this may by way of example be an operation duty corresponding to an office during normal working hour, such as 20° C.

The first fluid passage is supplied 100 with a known flow amount of the first fluid. This known flow amount is assumed to correspond to an amount to be fully evaporated before leaving the first fluid passage or shortly thereafter, i.e. it is assumed to correspond to that required to meet the decided set-point superheating temperature TshT.

The sensor arrangement downstream the outlet of the evaporator measures 200 the prevailing temperature Tm and the pressure Pm. These values are received by the controller 57.

The controller 57 converts 300 the measured pressure Pm into a saturation temperature Ts. The saturation temperature Ts is specific for a predetermined cooling agent, i.e. the first fluid used in the system. By way of example, provided the first fluid used is a cooling agent known as R410A, the saturation temperature Ts may be calculated by using the following formula specific for R410A:

$$Ts=0.0058Pm3-0.3141Pm2+7.8908Pm-46.0049.$$

The formula given above reflects the curve of a diagram wherein the saturation temperature is plotted versus a pressure. It is to be understood that the saturation pressure may be calculated in a number of ways, depending on e.g. different interpolation methods, different levels of accuracy etc. Further, it is to be understood that only a limited section of the curve may be evaluated. It is further to be understood that instead of calculating the saturation temperature Ts, the controller may be set to get the corresponding value by using a table containing the corresponding values.

The controller 57 establishes 400 the actual superheating temperature difference TshA prevailing at the specific point of time when the measuring was made by comparing the measured temperature Tm with the calculated saturation temperature Ts, by using the formula:

$$TshA=Tm-Ts.$$

Thus, the controller 57 has now established the prevailing, actual superheating difference TshA and it knows the set-point superheating temperature TshT. The next step is to decide the temperature difference ΔT 500 between the set-point superheating temperature TshT and the actual superheating temperature difference TshA by using the formula:

$$\Delta T=TshT-TshA$$

Based on the value of the temperature difference ΔT, the prevailing performance of the fluid passage 3*a* is evaluated 600. If ΔT is negative, the fluid passage is fed with an insufficient amount of fluid, whereby the controller may instruct the valve to increase the amount of fluid supplied to the fluid passage. If on the other hand ΔT is positive, the fluid passage is fed with too much fluid, whereby the controller may instruct the valve to decrease the amount of fluid supplied to the fluid passage. If ΔT=0, the performance of the fluid passage is optimized and no changes in the supplied flow amount are required.

It is to be known that there is no correlation between ΔT and the required amount of first fluid to be supplied. Non-limiting examples of influencing parameters are the design of the fluid passage 3*a*, the size of the fluid passage 3*a* and dimensional variations inside the fluid passage 3*a*. As a general rule of thumb, a large ΔT is indicative of the possibility of a large adjustment, whereas a small ΔT is indicative of the possibility of a small adjustment. The controller may by way of example be programmed to use different percental corrections depending on the absolute value of the temperature difference.

Based on the determined adjustment, the valve 22*a* is operated 700 to adjust the flow accordingly.

The process above is descried based on an evaporator 5 comprising one fluid passage 3*a* only. However, it is to be understood that for an evaporator 54 normally comprising a plurality of first fluid passages 3*a*, 3*b*, the above descried cycle is repeated 800 by subjecting each consecutive fluid passage 3*b* and its related injector arrangement 25*b* to the same procedure to thereby gradually step-by-step optimize the performance of the evaporator 54 as a whole and also maximizing the fluid amount handled by the evaporator as a whole.

It is to be understood that while evaluating one fluid passage 3*a*, the remaining fluid passages 3*b* and their related injector arrangements 25*b* may be operated in a known manner in order to be able to evaluate the performance of the evaluated fluid passage. After finishing the complete evaporator 54, the process may be started all over again with the first fluid passage 3*a*.

It is also to be understood that an evaporation system as such is a rather slow system since the components, i.e. the evaporator 54, the compressor 51, the condenser 52 and the ambient water/liquid/air to be cooled, each have their own influence to the overall performance of the system. Thus, for any changes in flow amounts to actually take effect, no rapid changes must be made.

In the example given above the flow supplied to a first fluid passage 3*a* evaluated is adjusted before continuing with evaluation the subsequent fluid passage 3*b*. In one alternative embodiment the controller 57 is arranged to store the determined value of the required flow adjustment to each evaluated flow passage 3*a*, 3*b* in its memory. Once all flow passages 3*a*, 3*b* have been evaluated in the same manner, the controller 57 may instruct each individual valve 22*a*, 22*b* to make the required flow adjustment. Thus, all flow adjustments may be made at the same time.

As an alternative to the sensor arrangement 28 comprising a pressure sensor 29 and temperature sensor 30, the sensor arrangement 28 may comprise at least one sensor arranged for detecting presence of any liquid content. The liquid content may be in liquid form or in mixed liquid/evaporated phase. One example of a suitable sensor is a temperature sensor 30.

The presence of any liquid content proves that the evaporation is insufficient and that the flow of first fluid should be reduced. As discussed above, the closer the superheating temperature, the closer to flooding the system with non-evaporated fluid. Since the superheating temperature may be regarded as being digital—there is either a complete evaporation with dry gas only, or there is an incomplete evaporation with a liquid content in the fluid downstream the evaporator.

In case the sensor arrangement 28 comprises a sensor for detecting presence of any liquid content in the evaporated fluid, such sensor/sensors should preferably be arranged in the tube system connecting the outlet of the evaporator with the inlet of the compressor. Thus, the position may be the same as in the system described above relating to FIG. 5. The only difference is that the pressure sensor 29 may be omitted. It is preferred for the sensor/sensors adapted to detect presence of any liquid content, e.g. a temperature sensor 30 is arranged in a position closer to the inlet 14 of the compressor 51 than to the outlet 13 of the evaporator 54. Further, it is preferred for such temperature sensor 30 to be positioned in the tube system 15 after at least one tube bend in order to allow at least some remaining liquid content to evaporate during contact with the inner walls of the tube system 15 or while coming into contact with the hot surrounding evaporated fluid flow. Thus, if measuring directly after the outlet 13 of the evaporator 54, a low amount of liquid content may be detected, whereas if measuring further downstream, such liquid content may have evaporated along the tube system whereby the evaporated flow reaching the compressor is dry. Thus, it is preferred that a sensor arrangement 28 based on detection of presence of any liquid content comprises at least two sensors 30*a*, 30*b* arranged in different positions along the tube system.

Figure 8:
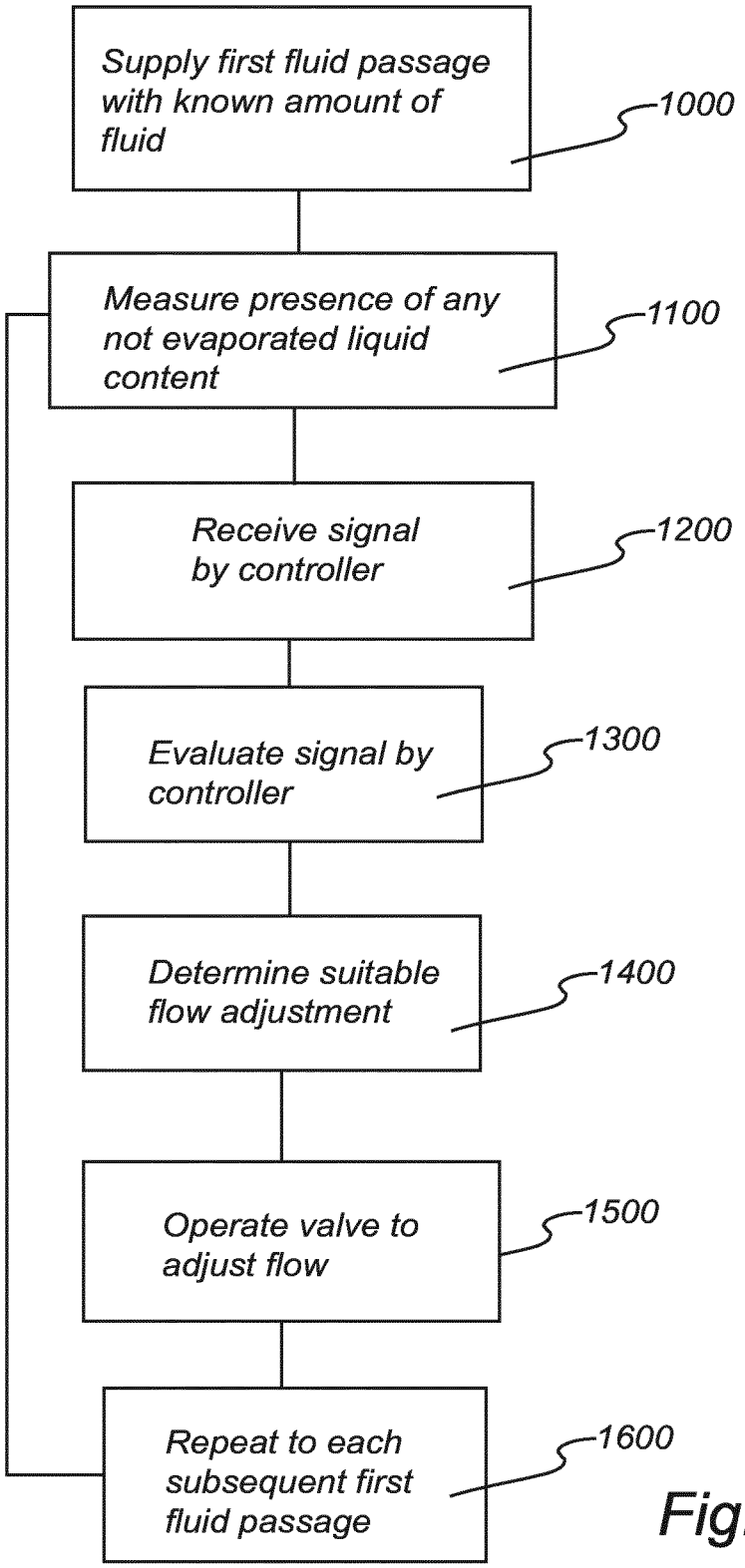
FIG. 8 discloses the steps of the inventive method using sensors for detecting any liquid content.

In the following the general principle for establishing the operation condition, i.e. superheating for a system using a sensor arrangement based on detection of any liquid content will be described with reference to FIG. 8. The evaporation system as such has the same general design as that previously described with reference to FIG. 6 whereby reference is made thereto.

To facilitate the understanding, the following example will be based on a system comprising an evaporator 54 with one fluid passage 3*a* only which is supplied with the first fluid via an injector arrangement 25*a* comprising one injector 23*a* and one valve 22*a*. Further, the example is based on the assumption that the system has been operated during a period of time in a predetermined operation duty.

The first fluid passage 3*a* is supplied with a known flow amount of the first fluid 1000. This known flow amount is assumed to correspond to an amount to be fully evaporated before leaving the first fluid passage 3*a* or shortly thereafter, i.e. it is assumed to correspond to that required to meet the decided set-point superheating temperature TshT.

The sensor arrangement 28 downstream the outlet of the evaporator measures the presence of any liquid content 1100. The signal generated by the sensor arrangement 28 is received 1200 by a controller 57. The controller may be a PID regulator.

The controller evaluates 1300 the received signal. In its most simple form the signal may be a digital signal: 1—no liquid content detected; 0—liquid content detected. More precisely, a signal having the value 1 indicates that the evaporated fluid has a measured temperature Tm corresponding to or being above the superheating temperature Tsh. Likewise, a signal having the value 0 indicates that the evaporated fluid has a temperature being below the superheating temperature.

In case the sensor arrangement 28 comprises two temperature sensors 30*a*, 30*b* arranged in different positions along the longitudinal extension of the tube system 15, the two sensors 30*a*, 30*b* may indicate different values. If both temperature sensors 30*a*, 30*b* indicate 0, this means that the gas is has a liquid content, and the evaporation is insufficient. The amount of first fluid supplied to the evaluated fluid passage 3*a* must be restricted since the system is flooded.

If the temperature sensor 30*a*, closest to the evaporator indicates 0 but the second sensor 30*b*, downstream thereof, indicates 1, this means that the evaluated fluid passage 3*a* is operating well since all supplied fluid is fully evaporated. It is also a good indicator of that if any flow adjustment should be made, the supplied flow should rather be reduced than increased to avoid flooding.

If both sensors 30*a*, 30*b* indicate 1, this means that all fluid supplied to the evaluated fluid passage 3*a* is evaporated. This means that the evaluated fluid passage 3*a* is not working optimally and that it is possible to increase the amount of first fluid supplied to the evaluated fluid passage.

Although one 30 or two 30*a*, 30*b* temperature sensors are described above, it is to be understood that more than two temperature sensors may be arranged, the sensors working with the same principle.

The controller 57 may be arranged to, when receiving a signal indicating presence or no presence of any liquid content, determine 1400 a suitable adjustment of the flow of first fluid to be provided by the valve 22*a* in an individual injector arrangement 25*a* to the evaluated fluid passage 3*a* in order to optimize its performance. Based on this determined adjustment, the valve 22*a* may be operated 1500 to adjust the flow accordingly.

The controller 57 may use different ranges of adjustments depending on a determined likeliness of the closeness to the superheating temperature.

The process above is descried based on an evaporator 54 comprising one fluid passage 3*a* only. However, it is to be understood that for an evaporator 54 normally comprising a plurality of first fluid passages 3*a*, the above descried cycle is repeated 1600 by subjecting each consecutive fluid passage 3*b*; 3*c* and its related injector arrangement 25*b*, 25*c* to the same procedure to thereby gradually step-by-step optimize the performance of the evaporator as a whole.

It is to be understood that while evaluating one fluid passage 3*a*, the remaining fluid passages 3*b*, 3*c* and their related injector arrangements 25*b*, 25*c* should be operated in a known manner in order to be able to evaluate the performance of the evaluated fluid passage 3*a*. After finishing the complete evaporator, the process may be started all over again with the first fluid passage.

In the example given above, the flow supplied to an evaluated first passage 3*a* is adjusted before continuing with evaluating the subsequent fluid passage 3*b*. In one alternative embodiment, the controller is arranged to store the determined value of the required flow adjustment to each evaluated flow passage 3*a*, 3*b* in its memory. Once all flow passages 3*a*, 3*b* have been evaluated in the same manner, the controller 57 may instruct each individual valve 22*a*, 22*b* to make the required flow adjustment. Thus, all flow adjustments may be made at the same time.

Accordingly, by the invention, each first fluid passage 3*a*, 3*b* may be operated in an optimized manner based on its inherent condition, such as position within the plate package P or dimensional differences between the two heat exchanger plates A, B delimiting the first fluid passage 3. This allows the operation of the evaporator 54 as a whole to be optimized. Also, this allows a better degree of utilization of the complete system in which the evaporator is forming part.

The controller 57 may store all received measurement data in a memory for use when determining flow adjustments. Further, the controller 57 may be arranged to use the history from such stored information when determining required flow adjustments.

No matter how the injectors arrangements are arranged, it is preferred that the flow is directed essentially in a direction in parallel with the flow direction through the evaporator. Thereby any undue re-direction of the fluid flow may be avoided. In case of the evaporator being a plate heat exchanger this means in parallel with the general plane of the first and the second heat exchanger plates.

The invention has been described as applied to an evaporator being a plate heat exchanger. However, it is to be understood that the invention is applicable no matter form of evaporator.

The injectors of the injector arrangements are disclosed as being arranged in through holes extending from the exterior of the plate package into the individual fluid passages. It is to be understood that this is only one possible embodiment. By way of example, the injectors of the injector arrangements may extend into any inlet port or the like depending on the design of the evaporator. This may by way of example be made by an insert along an inlet channel.

The invention has generally been described based on a plate heat exchanger having first and second plate interspaces and four port holes allowing a flow of two fluids. It is to be understood that the invention is applicable also for plate heat exchangers having different configurations in terms of the number of plate interspaces, the number of port holes and the number of fluids to be handled.

It is to be understood that the controller may be used for other purposes as well, such as control of the refrigerant circuit as such.

The invention is not limited to the embodiment disclosed but may be varied and modified within the scope of the following claims, which partly has been described above.

The invention claimed is:

1. System for dynamic control of operation of an evaporator, the system comprising an evaporator, a plurality of injector arrangements, a sensor arrangement and a controller, wherein the evaporator comprises a plate package positioned between first and second end plates, the plate package comprises a plurality of adjacent heat exchanger plates positioned between the first and second end plates and forming alternating first and second fluid passages between the first and second end plates, the evaporator also comprises an outlet and at least one inlet for the supply of a fluid to the outlet via the plurality of first fluid passages during evaporation of the fluid, each of the plurality of injector arrangements comprises at least one injector and at least one valve, and each injector arrangement being arranged to supply a flow of the fluid to at least one of the plurality of first fluid passages via the at least one inlet of the evaporator, the sensor arrangement is arranged to measure temperature and pressure of the evaporated fluid, or the presence of any liquid content in the evaporated fluid, and the controller individually evaluating each of the plurality of first fluid passages based on information received from the sensor arrangement and communicating with each of the valves of the injector arrangements to control, based on the respective evaluations, the amount of fluid to be supplied by each of the plurality of injector arrangements to the plurality of first fluid passages in the evaporator in order for the evaporator to operate towards a set-point superheating value.

2. System according to claim 1, wherein each injector in an injector arrangement of the plurality of injector arrangements is arranged to communicate with one valve, or wherein a plurality of injectors in each injector arrangement of the plurality of injector arrangements are arranged to communicate with one valve.

3. System according to claim 1, wherein each of the plurality of injector arrangements is arranged to communicate with one of the plurality of first fluid passages, or wherein each of the plurality of injector arrangements is arranged to communicate with at least two of the plurality of first fluid passages.

4. System according to claim 1, wherein the sensor arrangement is arranged in a tube system connecting the outlet of the evaporator with an inlet of a compressor.

5. System according to claim 1, wherein the controller is a PI regulator or a PID regulator.

6. System according to claim 1, wherein the evaporator is a plate heat exchanger.

7. System according to claim 1, wherein the sensor arrangement comprises at least one temperature sensor and at least one pressure sensor.

8. System according to claim 1, wherein the sensor arrangement arranged to measure the presence of any liquid content in the evaporated fluid is at least one temperature sensor.

9. Method for dynamic control of operation of an evaporator, the evaporator comprising a plurality of adjacent heat exchanger plates forming alternating first and second fluid passages, an outlet and an inlet for the supply of a fluid to the outlet via the plurality of first fluid passages during evaporation of the fluid, and the evaporator being included in a system further comprising a sensor arrangement, a controller and a plurality of injector arrangements, each injector arrangement comprising at least one injector and at least one valve, whereby the method comprises the steps of:

a) supplying via the inlet of the evaporator a pre-determined amount of fluid by one of the plurality of injector arrangements to one of the plurality of first fluid passages for evaporation of the fluid during its passage to the outlet of the evaporator, b) measuring by the sensor arrangement temperature and pressure of the evaporated fluid or the presence of any liquid content in the evaporated fluid, c) determining, by the controller, the difference $\Delta T$ between a set-point superheating value and the measured values of the temperature and the pressure of the evaporated fluid, or the presence of any liquid content in the evaporated fluid, resulting from the pre-determined amount of supplied fluid, d) determining, by the controller, an adjusted amount of fluid to be supplied by the at least one valve of the one of the plurality of injector arrangements to the one of the plurality of first fluid passages required to reach the set-point superheating value, and e) continuously repeating steps a)-d) on an individual basis for each of the plurality of injector arrangements and each of the fluid passages of the evaporator to continuously control the operation of the evaporator in order for the evaporator to operate towards the set-point superheating value.

10. Method according to claim 9, wherein the system is operated during a period of time in a predetermined operation duty before initiating step a).

11. Method according to claim 9, further comprising the steps of:

converting, by the controller, the measured pressure into a saturation temperature, determining the actual superheating temperature difference, prevailing at the specific point of time when the temperature and pressure was measured, by comparing the measured temperature Tm with the saturation temperature, determining the temperature difference between a set-point superheating value being a set-point superheating temperature and the actual superheating temperature difference, and determining, based on the temperature difference, the need for any adjustment of the amount of fluid supplied by the valve of a first injector of the plurality of injector arrangements to the one of the first fluid passages of the plurality of fluid passages, and instructing the valve of the first injector arrangement of the plurality of injector arrangements to adjust the amount of fluid to be supplied by the first injector arrangement of the plurality of injector arrangements to the first fluid passage.

12. Method according to claim 9, wherein the sensor arrangement is a humidity sensor, whereby the method further comprises the step of, provided the humidity sensor generates a signal received by the controller indicating presence of any liquid content in the evaporated fluid, instructing the valve of the first injector arrangement of the plurality of injector arrangements to reduce the amount of fluid supplied to the first fluid passage, or provided the humidity sensor generates a signal received by the controller indicating no presence of any liquid content in the evaporated fluid, instructing the valve of the first injector arrangement to increase the amount of fluid supplied to the first fluid passage.

13. Method according to claim 9, wherein the sensor arrangement comprises at least two humidity sensors, whereby the method further comprises the steps of comparing the signals received by the controller from the at least two humidity sensors indicating presence or no presence of liquid content in the evaporated fluid in order to determine if to instruct the valve of the first injector arrangement of the plurality of injector arrangements to increase, decrease or maintain the supplied amount of fluid to the one of the first fluid passages of the plurality of fluid passages, and instructing the valve of the first injector arrangement of the plurality of injector arrangements to adjust the amount of fluid to be supplied by the first injector arrangement of the plurality of injector arrangements to the one of the first fluid passages of the plurality of fluid passages accordingly.

14. Method according to claim 9, further comprising, before continuing to step e), the step of communicating the determined adjusted amount of fluid to the valve of the first injector arrangement of the plurality of injector arrangements and adjusting the valve of the first injector arrangement of the plurality of injector arrangements to supply an adjusted amount of fluid.

15. Method according to claim 9, further comprising a step of communicating the determined adjusted amount of fluid to the valves of each injector arrangement of the plurality of injector arrangements and adjusting the valves to supply an adjusted amount of fluid to all fluid passages of the plurality of fluid passages of the evaporator.

16. Method according to claim 9, when the operation of the evaporator has been operated to an operation duty meeting the set-point superheating value, further comprising the step of adjusting the set-point superheating value and then repeating the method of claim 9, for the purpose of providing a continuous control of the operation of the evaporator in order for the evaporator to operate towards the adjusted set-point superheating value.

17. System according to claim 1, wherein the outlet of the evaporator is connected to an inlet of a compressor by a tube system, and the sensor arrangement comprises two temperature sensors spaced apart along the tube system that connects the outlet of the evaporator with the inlet of the compressor.

18. Method according to claim 9, wherein the outlet of the evaporator is connected to an inlet of a compressor by a tube system, and the sensor arrangement comprises two temperature sensors spaced apart along the tube system that connects the outlet of the evaporator with the inlet of the compressor.

19. System for dynamic control of operation of an evaporator, the system comprising an evaporator, a plurality of injector arrangements, a sensor arrangement and a controller;

the evaporator comprising a plate package defined by heat exchanger plates positioned between two end plates, an outlet, a plurality of fluid passages positioned between adjacent ones of the heat exchanger plates, and at least one inlet for the supply of a fluid to the outlet via the plurality of fluid passages during evaporation of the fluid, each injector arrangement of the plurality of injector arrangements comprising at least one injector and at least one valve, and each injector arrangement of the plurality of injector arrangements is positioned in a respective through hole passing through a respective one of the heat exchanger plates of the plate package to supply a flow of the fluid to at least one of the fluid passages of the plurality of fluid passages via the at least one inlet of the evaporator the sensor arrangement being arranged to measure temperature and pressure of an evaporated fluid, or the presence of any liquid content in the evaporated fluid; and the controller individually evaluating each of the fluid passages of the plurality of fluid passages based on information received from the sensor arrangement and communicating with each of the valves of each injector arrangement of the plurality of injector arrangements to control, based on the respective evaluations, the amount of fluid to be supplied by each injector arrangement of the plurality of injector arrangements to each respective fluid passage of the plurality of fluid passages in the evaporator in order for the evaporator to operate towards a set-point superheating value.

* * * * *